US007175965B2

(12) United States Patent
Kawamura

(10) Patent No.: US 7,175,965 B2
(45) Date of Patent: Feb. 13, 2007

(54) PRINTING PLATE MATERIAL

(75) Inventor: Tomonori Kawamura, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

(21) Appl. No.: 11/052,857

(22) Filed: Feb. 9, 2005

(65) Prior Publication Data

US 2005/0181302 A1 Aug. 18, 2005

(30) Foreign Application Priority Data

Feb. 12, 2004 (JP) ..... 2004-034721

(51) Int. Cl.
*G03G 7/004* (2006.01)

(52) U.S. Cl. ..... 430/270.1; 430/138; 430/302

(58) Field of Classification Search ..... 430/270.1, 430/138, 302
See application file for complete search history.

(56) References Cited

U.S. PATENT DOCUMENTS 6,420,083 B1 * 7/2002 Kawamura ..... 430/270.1
6,551,759 B2 * 4/2003 Daems et al. ..... 430/273.1
6,589,710 B2 * 7/2003 Christall et al. ..... 430/302
6,641,976 B2 * 11/2003 Vermeersch et al. ..... 430/270.1
2004/0081908 A1 * 4/2004 Shimazu et al. ..... 430/152
2004/0157162 A1 * 8/2004 Yokota et al. ..... 430/306

FOREIGN PATENT DOCUMENTS

EP 1 092 555 A1 4/2001
EP 1 145 848 A2 10/2001
EP 1 243 410 A1 9/2002

* cited by examiner

*Primary Examiner*—Barbara L. Gilliam
(74) *Attorney, Agent, or Firm*—Finnegan, Henderson, Farabow, Garrett & Dunner, L.L.P.

(57) ABSTRACT

Disclosed is a printing plate material comprising a hydrophilic support and provided thereon, an image formation layer containing thermoplastic resin particles in an amount of from 60 to 100% by weight, the thermoplastic resin particles having a glass transition point (Tg) and an average particle size of from 0.01 to 2 μm.

10 Claims, 2 Drawing Sheets

PRINTING PLATE MATERIAL

FIELD OF THE INVENTION

The present invention relates to a printing plate material, and particularly to a printing plate material capable of forming an image according to a computer to plate (CTP) system.

BACKGROUND OF THE INVENTION

The printing plate material for CTP, which is inexpensive, can be easily handled, and has a printing ability comparable with that of a PS plate, is required accompanied with the digitization of printing data. Recently, a thermal processless printing plate material which can be applied to a printing press employing a direct imaging (DI) process without development by a special developing agent or a versatile thermal processless printing plate material which can be treated in the same manner as in PS plates has been required.

As a thermal processless printing plate material, there is Thermo-Lite produced by Agfa Co., Ltd. In a thermal processless printing plate material, an image is formed according to a recording method employing an thermal laser emitting light with infrared to near infrared wavelengths. The thermal processless type printing plate material employing this recording method is divided into an ablation type printing plate material, a development-on-press type heat fusible image formation layer-containing printing plate material, and a phase change type printing plate material.

Examples of the ablation type printing plate material include those disclosed in for example, Japanese Patent O.P.I. Publication Nos. 8-507727, 6-186750, 6-199064, 7-314934, 10-58636 and 10-244773.

Examples of the development-on-press type heat fusible image formation layer-containing printing plate material include printing plate materials disclosed in for example, Japanese Patent Publication Nos. 2938397 and 2938398, in which hydrophobic thermoplastic polymer particles can be combined with one another by heat application. However, no reference is made to adhesion of the polymer particles to the support.

Examples of the phase change type printing plate material include those disclosed in for example, Japanese Patent O.P.I. Publication No. 11-240270. In the phase change type printing plate material, the hydrophilic layer contains hydrophobe precursor particles, which are not removed during printing, and the hydrophilic layer at exposed portions changes to be hydrophobic.

A planographic printing plate material employing heat melting particles with a melting point of from 40 to 150° C. having specific physical properties is disclosed (see for example, Japanese Patent O.P.I. Publication No. 2001-200059.). Most of the heat melting particles with that melting point disclosed in the patent document above have a relatively low molecular weight. The relatively low molecular weight particles are poor in poor abrasion resistance, water resistance and oil resistance, and has problem in that they are severely damaged during printing, resulting in lowering of printing durability.

SUMMARY OF THE INVENTION

An object of the invention is to provide a printing plate material, capable of being subjected to on-press development on a printing press, which provides excellent dot reproduction and improved print quality, and minimizes "ghost" resulting from stains of a blanket of a printing press, stains resulting from printing ink or dampening solution, and waste paper sheets at an initial stage of printing.

Figure 1:
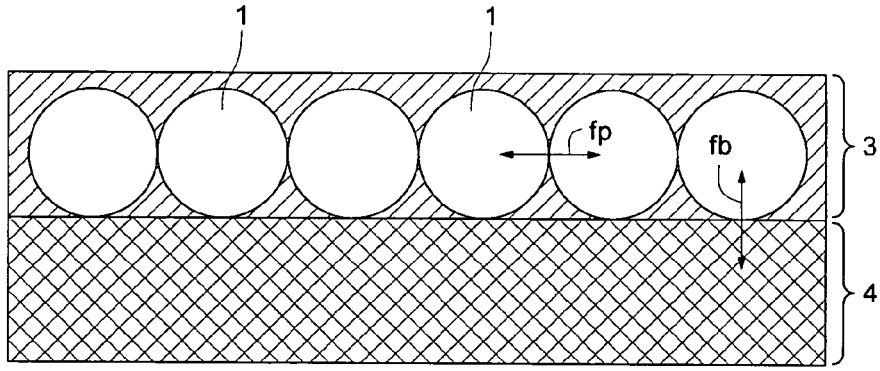
FIG. 1(*a*) is a sectional view of a printing plate material of the invention before heated, FIG. 1(*b*) is a sectional view of a printing plate material of the invention after imagewise heated.
Figure 1:
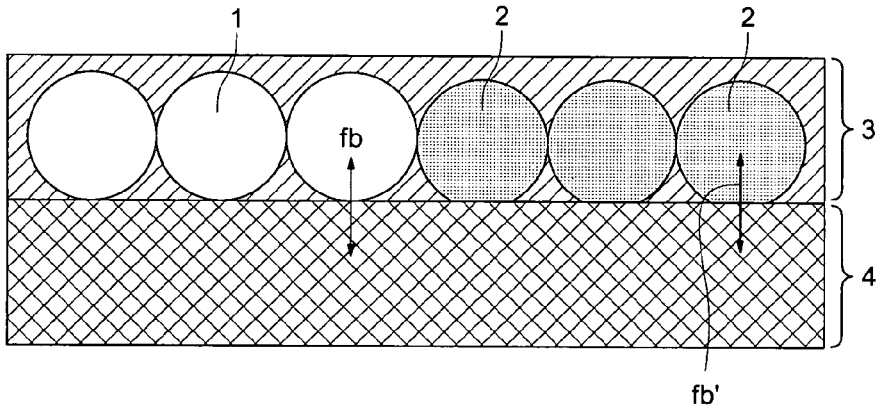

The above object of the invention can be attained by the following constitutions:

1-1. A printing plate material comprising a hydrophilic support and provided thereon, an image formation layer containing thermoplastic resin particles in an amount of from 60 to 100% by weight, the thermoplastic resin particles having a glass transition point (Tg) and an average particle size of from 0.01 to 2 μm.

1-2. The printing plate material of item 1 above, wherein the content of the thermoplastic resin particles in the image formation layer is from 80 to 100% by weight.

1-3. The printing plate material of item 1-1 above, wherein the glass transition point (Tg) of the thermoplastic resin particles is not less than 40° C.

1-4. The printing plate material of item 1-1 above, wherein the thermoplastic resin particles are thermoplastic polyester particles.

1-5. The printing plate material of item 1-1 above, wherein the image formation layer contains a water soluble resin or a water dispersible resin in an amount of not more than 20% by weight.

1-6. The printing plate material of item 1-2 above, wherein the image formation layer contains a water soluble resin or a water dispersible resin in an amount of not more than 20% by weight.

1-7. The printing plate material of item 1-5 above, wherein the water soluble resin or the water dispersible resin is selected from the group consisting of oligosaccharides, polysaccharides, polyacrylic acid, polyacrylic acid salts, and polyacrylamide.

1-8. The printing plate material of item 1-1 above, wherein the image formation layer contains a light-to-heat conversion material in an amount of not more than 10% by weight.

1-9. The printing plate material of item 1-1 above, wherein the image formation layer contains a light-to-heat conversion material in an amount of not more than 10% by weight, and a water soluble resin or a water dispersible resin in an amount of not more than 20% by weight.

1-10. The printing plate material of item 1-1 above, wherein the following relation is satisfied, $$L \leqq d \leqq 5L$$

wherein d represents the thickness of the image formation layer, and L represents the average particle size of the thermoplastic resin particles.

1-11. A process of manufacturing a printing plate material comprising a hydrophilic support and provided thereon, an image formation layer containing thermoplastic resin particles in an amount of from 60 to 100% by weight, the thermoplastic resin particles having a glass transition point (Tg) and an average particle size of from 0.01 to 2 μm, the process comprising the steps of providing a coating solution of the image formation layer, coating the coating solution on the support to form a coated layer on the support, and drying the coated layer at a temperature of not more than the glass transition point (Tg) of the resin particles.

DETAILED DESCRIPTION OF THE INVENTION

The present invention will be detailed below.

The printing plate material of the invention comprises a hydrophilic support and provided thereon, an image formation layer containing thermoplastic resin particles in an amount of from 60 to 100% by weight, the thermoplastic resin particles having a glass transition point (Tg) and an average particle size of from 0.01 to 2 μm.

In the invention, the particle size of particles refers to a diameter of a circle having the same area as the projected image of the particles in an SEM photograph of the particles, and the average particle size of particles refers to the average of the particle size of arbitrarily selected 50 particles in the SEM photograph. Herein, the SEM photograph of the particles was taken by means of a scanning electron microscope S-800 (produced by Hitachi Seisakusho Co., Ltd.) at a magnification of 50,000.

(Support)

As the support in the invention, those well known in the art as supports for printing plates can be used. Examples of the support include a metal plate, a plastic film sheet, a paper sheet treated with polyolefin, and composite materials such as laminates thereof. The thickness of the support is not specifically limited as long as a printing plate having the support can be mounted on a printing press, and is advantageously from 50 to 500 μm in easily handling.

Examples of the metal plate include iron, stainless steel, and aluminum. Aluminum is especially preferable in its gravity and stiffness. Aluminum is ordinarily used after degreased with an alkali, an acid or a solvent to remove oil on the surface, which has been used when rolled and wound around a spool. The degreasing is carried out preferably employing an aqueous alkali solution. In order to increase adhesion between the support and a coating layer, it is preferred that the surface of the support is subjected to adhesion increasing treatment or is coated with a subbing layer. For example, the support is immersed in a solution containing silicate or a coupling agent such as a silane coupling agent, or the support is coated with the solution and then sufficiently dried. Anodization treatment is considered to be one kind of adhesion increasing treatment, and can be used. The anodization treatment and the immersing or coating treatment described above can be used in combination. Aluminum plate (so-called grained aluminum plate), which has been surface-roughened with a conventional method, can be used as a support having a hydrophilic surface.

The aluminum plate used in the printing plate material in the invention is an aluminum plate or an aluminum alloy plate. As the aluminum alloy, there can be used various ones including an alloy of aluminum and a metal such as silicon, copper, manganese, magnesium, chromium, zinc, lead, bismuth, nickel, titanium, sodium or iron.

It is preferable that the aluminum plate is subjected to degreasing treatment for removing rolling oil prior to surface roughening. The degreasing treatments include degreasing treatment employing solvents such as trichlene and thinner, and an emulsion degreasing treatment employing an emulsion such as kerosene or triethanol. It is also possible to use an aqueous alkali solution such as an aqueous solution of sodium hydroxide, potassium hydroxide, sodium carbonate, or sodium phosphate for the degreasing treatment. When such an aqueous alkali solution is used for the degreasing treatment, it is possible to remove soils and an oxidized film which can not be removed by the above-mentioned degreasing treatment alone. When the aqueous alkali solution is used for the degreasing treatment, the resulting plate is preferably subjected to neutralization treatment in an aqueous solution of an acid such as phosphoric acid, nitric acid, sulfuric acid, chromic acid, or in an aqueous solution of a mixture thereof. The electrolytic surface roughening after the neutralization is carried out preferably in the same acid solution as in the neutralization treatment.

The electrolytic surface roughening treatment of the aluminum plate is carried out according to a known method, but prior to that, chemical surface roughening treatment and/or mechanical surface roughening treatment may be carried out. The mechanical surface roughening treatment is preferably carried out.

The chemical surface roughening treatment is carried out employing an aqueous alkali solution such as an aqueous solution of sodium hydroxide, potassium hydroxide, sodium carbonate, or sodium phosphate in the same manner as in degreasing treatment above. After that, the resulting plate is preferably subjected to neutralization treatment in an aqueous solution of an acid such as phosphoric acid, nitric acid, sulfuric acid, chromic acid, or in an aqueous solution of a mixture thereof. The electrolytic surface roughening after the neutralization is carried out preferably in the same acid solution as in the neutralization treatment.

Though there is no restriction for the mechanical surface roughening method, a brushing roughening method and a honing roughening method are preferable. The brushing roughening method is carried out by rubbing the surface of the plate with a cylindrical brush with a brush hair with a diameter of 0.2 to 1 mm, while supplying slurry, in which an abrasive is dispersed in water, to the surface of the plate. The honing roughening method is carried out by ejecting obliquely slurry, in which an abrasive is dispersed in water, with pressure applied from nozzles to the surface of the plate. Examples of the abrasive include those generally used as abrasives such as volcanic ashes, alumina, or silicon carbide. The particle size of the abrasive is #200 to #3000, preferably #400 to #2000, and more preferably #600 to #1000.

After the plate has been roughened mechanically, it is preferably dipped in an acid or an aqueous alkali solution in order to remove abrasives and aluminum dust, etc. which have been embedded in the surface of the support or to control the shape of pits formed on the plate surface, whereby the surface is etched. Examples of the acid include sulfuric acid, persulfuric acid, hydrofluoric acid, phosphoric acid, nitric acid and hydrochloric acid, and examples of the alkali include sodium hydroxide and potassium hydroxide.

In the invention, the aluminum plate was mechanically surface roughened with an abrasive with a particle size of not less than #400, followed by etching treatment employing an aqueous alkali solution, whereby a complex surface structure formed due to the mechanical surface roughening treatment can be changed to a surface having a smooth convexoconcave structure. The resulting aluminum plate has a waviness of a relatively long wavelength of several microns to scores microns. The resulting aluminum plate further being subjected to electrolytic surface roughening treatment described later, an aluminum support is obtained which provides a good printing performance and good printing durability. Further, the aluminum plate can reduce a quantity of electricity during the electrolytic surface roughening treatment, contributing to cost reduction.

The resulting plate after dipped in the aqueous alkali solution is preferably subjected to neutralization treatment in an aqueous solution of an acid such as phosphoric acid, nitric acid, sulfuric acid, chromic acid, or in an aqueous solution of a mixture thereof. The electrolytic surface roughening after the neutralization is preferably carried out in the same acid solution as in the neutralization treatment.

The electrolytic surface roughening treatment in the invention is carried out in an acidic electrolytic solution employing an alternating current. As the acidic electrolytic solution, an acidic electrolytic solution used in a conventional electrolytic surface roughening treatment can be used, but a hydrochloric acid or nitric acid electrolytic solution is preferably used. In the invention, a hydrochloric acid electrolytic solution is especially preferably used. As a current waveform used in the electrolytic surface roughening treatment, various waveforms such as a rectangular wave, trapezoidal wave, sawtooth wave or sine wave can be used, but sine wave is preferably used. Separated electrolytic surface roughening treatments disclosed in Japanese Patent O.P.I. Publication No. 10-869 are also preferably used.

In the electrolytic surface roughening treatment carried out using an electrolytic solution of nitric acid, voltage applied is preferably from 1 to 50 V, and more preferably from 5 to 30 V. The current density (in terms of peak value) used is preferably from 10 to 200 A/dm$^2$, and more preferably from 20 to 150 A/dm$^2$. The total quantity of electricity is preferably 100 to 2000 C/dm$^2$, more preferably 200 to 1500 C/dm$^2$, and most preferably 200 to 1000 C/dm$^2$. Temperature during the electrolytic surface roughening treatment is preferably from 10 to 50° C., and more preferably from 15 to 45° C. The nitric acid concentration in the electrolytic solution is preferably from 0.1% by weight to 5% by weight. It is possible to optionally add, to the electrolytic solution, nitrates, chlorides, amines, aldehydes, phosphoric acid, chromic acid, boric acid, acetic acid or oxalic acid.

In the electrolytic surface roughening treatment carried out using an electrolytic solution of hydrochloric acid, voltage applied is preferably from 1 to 50 V, and more preferably from 5 to 30 V. The current density (in terms of peak value) used is preferably from 10 to 200 A/dm$^2$, and more preferably from 20 to 150 A/dm$^2$. The total quantity of electricity is preferably 100 to 2000 C/dm$^2$, and more preferably 200 to 1000 C/dm$^2$. Temperature during the electrolytic surface roughening treatment is preferably from 10 to 50° C., and more preferably from 15 to 45° C. The hydrochloric acid concentration in the electrolytic solution is preferably from 0.1% by weight to 5% by weight. It is possible to optionally add, to the electrolytic solution, nitrates, chlorides, amines, aldehydes, phosphoric acid, chromic acid, boric acid, acetic acid or oxalic acid.

In the invention, the electrolytically surface roughened plate is dipped and subjected to etching treatment in an aqueous alkali solution in order to remove aluminum dust produced on the plate surface, or to control the shape of pits formed on the plate surface, whereby the surface is etched. Examples of the alkali solution include a solution of sodium hydroxide, potassium hydroxide, sodium carbonate or sodium phosphate. This etching treatment improves initial printability and anti-stain property of a printing plate material comprising an image formation layer.

Etching treatment after electrolytically surface roughening can be carried out employing a solution of an acid such as a sulfuric acid, persulfuric acid, hydrofluoric acid, phosphoric acid, nitric acid, or hydrochloric acid. Etching treatment employing an acid solution is likely to lower initial printability or anti-stain property of a printing plate material.

The reason is not clear. This is probably because etching treatment due to alkalis provides a fine surface structure of the electrolytically surface roughened plate different from etching treatment due to acids. Etching treatment due to alkalis, if etching amount is small, easily dissolves aluminum of the plate surface to give a surface having a smooth convexoconcave structure as described above, whereby a component in the image formation layer from which stains result, e.g., a light-to-heat conversion material to be described later or a visualizing agent is easily removed during on-press development.

When the surface of the electrolytically surface roughened aluminum plate is etched in the aqueous alkali solution, the etching amount of the aluminum plate is preferably from 0.05 to 2.0 g/m$^2$. The etching amount less than 0.05 g/m$^2$ has problem in that smuts produced on the plate surface are not completely removed, and the etching amount exceeding 2.0 g/m$^2$ has problem in that pits formed during the electrolytic surface roughening treatment has been excessively dissolved, lowering printing durability.

The resulting plate after dipped in the aqueous alkali solution in the above is preferably subjected to neutralization treatment in an aqueous solution of an acid such as phosphoric acid, nitric acid, sulfuric acid, chromic acid, or in an aqueous solution of a mixture thereof. The anodization treatment after the neutralization treatment is carried out preferably in the same acid solution as in the neutralization treatment.

After the aluminum plate has been subjected to each of the surface treatments described above, it is subjected to anodization treatment. There is no restriction in particular for the method of anodization treatment used in the invention, and known methods can be used. The anodization treatment forms an anodization film on the surface of the aluminum plate. For the anodization treatment in the invention there is preferably used a method of carrying out electrolysis by applying a current density of from 1 to 10 A/dm$^2$ to an aqueous solution containing sulfuric acid and/or phosphoric acid in a concentration of from 10 to 50%, as an electrolytic solution. However, it is also possible to use a method of carrying out electrolysis by applying a high current density to sulfuric acid as described in U.S. Pat. No. 1,412,768, or a method of carrying out electrolysis in phosphoric acid as described in U.S. Pat. No. 3,511,661.

The aluminum plate, which has been subjected to anodization treatment, is optionally subjected to sealing treatment. For the sealing treatment, it is possible to use known sealing treatment carried out using hot water, boiling water, steam, an aqueous dichromate solution, a nitrite solution and an ammonium acetate solution. The aluminum plate subjected to anodization treatment may be subjected to surface treatment other than the sealing treatment. Examples of the surface treatment include known treatments such as silicate treatment, phosphate treatment, various organic acid treatment, PVPA treatment and boehmite treatment. Further, the aluminum plate subjected to anodization treatment may be subjected to surface treatment disclosed in Japanese Patent O.P.I. Publication No. 8-314157 in which the aluminum plate is treated in an aqueous bicarbonate solution or the aluminum plate is treated in an aqueous bicarbonate solution, followed by treatment in an organic acid solution such as an aqueous citric acid solution.

Examples of the plastic film include a polyethylene terephthalate film, a polyethylene naphthalate film, a polyimide film, a polyamide film, a polycarbonate film, a polysulfone film, a polyphenylene oxide film, and a cellulose ester film.

A support with a backcoat layer on the side (rear surface) opposite the image formation layer can be preferably used in order to control slippage of a rear surface (for example, to decrease the friction of the rear surface to the plate cylinder of a printing press).

(Hydrophilic Layer)

In the printing plate material of the invention, a hydrophilic layer is preferably provided on the support to contact an image formation layer described later. Material used in the hydrophilic layer is preferably a metal oxide. The metal oxide is preferably metal oxide particles. Examples of the metal oxide particles include colloidal silica particles, an alumina sol, a titania sol and another metal oxide sol. The metal oxide particles may have any shape such as spherical, needle-like, and feather-like shape. The average particle size is preferably from 3 to 100 nm, and plural kinds of metal oxide each having a different size may be used in combination. The surface of the particles may be subjected to surface treatment. The metal oxide particles can be used as a binder, utilizing its layer forming ability. The metal oxide particles are suitably used in a hydrophilic layer since they minimize lowering of the hydrophilicity of the layer as compared with an organic compound binder.

Among the above-mentioned, colloidal silica is particularly preferred. The colloidal silica has a high layer forming ability under a drying condition with a relative low temperature, and can provide a good layer strength.

It is preferred that the colloidal silica used in the invention is necklace-shaped colloidal silica or colloidal silica particles having an average particle size of not more than 20 nm, each being described later. Further, it is preferred that the colloidal silica provides an alkaline colloidal silica solution as a colloid solution.

The necklace-shaped colloidal silica to be used in the invention is a generic term of an aqueous dispersion system of spherical silica having a primary particle size of the order of nm. The necklace-shaped colloidal silica to be used in the invention means a "pearl necklace-shaped" colloidal silica formed by connecting spherical colloidal silica particles each having a primary particle size of from 10 to 50 μm so as to attain a length of from 50 to 400 nm. The term of "pearl necklace-shaped" means that the image of connected colloidal silica particles is like to the shape of a pearl necklace. The bonding between the silica particles forming the necklace-shaped colloidal silica is considered to be —Si—O—Si—, which is formed by dehydration of —SiOH groups located on the surface of the silica particles. Concrete examples of the necklace-shaped colloidal silica include Snowtex-PS series produced by Nissan Kagaku Kogyo, Co., Ltd.

The hydrophilic layer of the printing plate material of the invention preferably contains porous metal oxide particles as metal oxides. Examples of the porous metal oxide particles include porous silica particles, porous aluminosilicate particles or zeolite particles as described later.

(Porous Silica Particles, Porous Aluminosilicate)

The porous silica particles are ordinarily produced by a wet method or a dry method. By the wet method, the porous silica particles can be obtained by drying and pulverizing a gel prepared by neutralizing an aqueous silicate solution, or pulverizing the precipitate formed by neutralization. By the dry method, the porous silica particles are prepared by combustion of silicon tetrachloride together with hydrogen and oxygen to precipitate silica. The porosity and the particle size of such particles can be controlled by variation of the production conditions. The porous silica particles prepared from the gel by the wet method is particularly preferred.

The porous aluminosilicate particles can be prepared by the method described in, for example, JP O.P.I. No. 10-71764. Thus prepared aluminosilicate particles are amorphous complex particles synthesized by hydrolysis of aluminum alkoxide and silicon alkoxide as the major components. The particles can be synthesized so that the ratio of alumina to silica in the particles is within the range of from 1:4 to 4:1. Complex particles composed of three or more components prepared by an addition of another metal alkoxide may also be used in the invention. In such a particle, the porosity and the particle size can be controlled by adjustment of the production conditions.

The porosity of the particles is preferably not less than 1.0 ml/g, more preferably not less than 1.2 ml/g, and most preferably of from 1.8 to 2.5 ml/g, in terms of pore volume before the dispersion.

The pore volume is closely related to water retention of the coated layer. As the pore volume increases, the water retention is increased, stain is difficult to occur, and water tolerance is high. Particles having a pore volume of more than 2.5 ml/g are brittle, resulting in lowering of durability of the layer containing them. Particles having a pore volume of less than 1.0 ml/g results in lowering of anti-stain property or water tolerance in printing. The particle size of the particles dispersed in the hydrophilic layer (or in the dispersed state before formed as a layer) is preferably not more than 1 μm, and more preferably not more than 0.5 μm. Presence in the hydrophilic layer of particles with an extremely large size forms porous and sharp protrusions on the hydrophilic layer surface, and ink is likely to remain around the protrusions, which may produce stain at non-image portions of the printing plate and on the blanket of a press during printing.

(Zeolite Particles)

Zeolite is a crystalline aluminosilicate, which is a porous material having voids of a regular three dimensional net work structure and having a pore size of 0.3 to 1 nm. Natural and synthetic zeolites are expressed by the following formula.

$$(M1, (M2)_{1/2})_m(Al_mSi_nO_{2(m+n)}).xH_2O$$

In the above, M1 and M2 are each exchangeable cations. Examples of M1 include $Li^+$, $Na^+$, $K^+$, $Tl^+$, $Me_4N^+$ (TMA), $Et_4N+$ (TEA), $Pr_4N^+$(TPA), $C_7H_{15}N^{2+}$, and $C_8H_{16}N^+$, and examples of $M^2$ include $Ca^{2+}$, $Mg^{2+}$, $Ba^{2+}$, $Sr^{2+}$ and $(C_8H_{18}N)_2{}^{2+}$. Relation of n and m is n≧m, and consequently, the ratio of m/n, or that of Al/Si is not more than 1. A higher Al/Si ratio shows a higher content of the exchangeable cation, and a higher polarity, resulting in higher hydrophilicity. The Al/Si ratio is within the range of preferably from 0.4 to 1.0, and more preferably 0.8 to 1.0. "x" is an integer.

The particle size of the porous inorganic particles in the hydrophilic layer is preferably not more than 1 μm, and more preferably not more than 0.5 μm.

An aqueous solution of a silicate is also usable as another additive to the hydrophilic layer in the invention. An alkali metal silicate such as sodium silicate, potassium silicate or lithium silicate is preferable, and the $SiO_2/M_2O$ (M represents an alkali metal) is preferably selected so that the pH value of the coating liquid after addition of the silicate exceeds 13 in order to prevent dissolution of the porous metal oxide particles or the colloidal silica particles.

An inorganic polymer or an inorganic-organic hybrid polymer prepared by a sol-gel method employing a metal alkoxide. Known methods described in S. Sakka "Application of Sol-Gel Method" or in the publications cited in the above publication can be applied to prepare the inorganic polymer or the inorganic-organic hybridpolymer by the sol-gel method.

In the invention, the hydrophilic layer preferably contains a hydrophilic resin. Examples of the hydrophilic resin include polysaccharides, polyethylene oxide, polypropylene oxide, polyvinyl alcohol, polyethylene glycol (PEG), polyvinyl ether, a styrene-butadiene copolymer, a conjugation diene polymer latex of methyl methacrylate-butadiene copolymer, an acryl polymer latex, a vinyl polymer latex, polyacrylamide, and polyvinyl pyrrolidone.

A cationic resin may also be contained in the hydrophilic layer. Examples of the cationic resin include a polyalkylenepolyamine such as a polyethyleneamine or polypropylenepolyamine or its derivative, an acryl resin having a tertiary amino group or a quaternary ammonium group and diacrylamine. The cationic resin may be added in a form of fine particles. Examples of such particles include the cationic microgel described in Japanese Patent O.P.I. Publication No. 6-161101.

As the polysaccharide, starches, celluloses, polyuronic acid and pullulan can be used. Among them, a cellulose derivative such as a methyl cellulose salt, a carboxymethyl cellulose salt or a hydroxyethyl cellulose salt is preferable, and a sodium or ammonium salt of carboxymethyl cellulose is more preferable.

These polysaccharides can exhibit effect that forms a preferred surface shape of the hydrophilic layer. Material A which is a polysaccharide, also provides this effect.

The surface of the hydrophilic layer preferably has a convexoconcave structure having a pitch of from 0.1 to 50 μm such as the grained aluminum surface of an aluminum PS plate. The water retention ability and the image maintaining ability are raised by such a convexoconcave structure of the surface. Such a convexoconcave structure can also be formed by adding in an appropriate amount a filler having a suitable particle size to the coating liquid of the hydrophilic layer. However, the convexoconcave structure is preferably formed by coating a coating liquid for the hydrophilic layer containing the alkaline colloidal silica and the water-soluble polysaccharide so that the phase separation occurs at the time of drying the coated liquid, whereby a structure is obtained which provides a good printing performance.

The shape of the convexoconcave structure such as the pitch and the surface roughness thereof can be suitably controlled by the kinds and the adding amount of the alkaline colloidal silica particles, the kinds and the adding amount of the water-soluble polysaccharide, the kinds and the adding amount of another additive, a solid concentration of the coating liquid, a wet layer thickness or a drying condition.

The pitch in the convexoconcave structure is preferably from 0.2 to 30 μm, and more preferably from 0.5 to 20 μm. A multi-layered convexoconcave structure may be formed in which a convexoconcave structure with a smaller pitch is formed on one with a larger pitch. The hydrophilic layer has a surface roughness Ra of preferably from 100 to 1000 nm, and more preferably from 150 to 600 nm.

The thickness of the hydrophilic layer is from 0.01 to 50 μm, preferably from 0.2 to 10 μm, and more preferably from 0.5 to 3 μm.

A water-soluble surfactant may be added for improving the coating ability of the coating liquid for the hydrophilic layer in the invention. A silicon atom-containing surfactant, a fluorine atom-containing surfactant or acetylene glycol surfactant is preferably used. The content of the surfactant is preferably from 0.01 to 3% by weight, and more preferably from 0.03 to 1% by weight based on the total weight of the hydrophilic layer (or the solid content of the hydrophilic layer coating liquid).

The hydrophilic layer in the invention can contain a phosphate. Since a coating liquid for the hydrophilic layer is preferably alkaline, the phosphate to be added to the hydrophilic layer is preferably sodium phosphate or sodium monohydrogen phosphate. The addition of the phosphate provides improved reproduction of dots at shadow portions. The content of the phosphate is preferably from 0.1 to 5% by weight, and more preferably from 0.5 to 2% by weight in terms of amount excluding hydrated water.

The hydrophilic layer in the invention preferably contains a light-to-heat conversion material described below. Examples of the light-to-heat conversion material include the following substances.

Examples of the light-to-heat conversion material include a general infrared absorbing dye such as a cyanine dye, a chloconium dye, a polymethine dye, an azulenium dye, a squalenium dye, a thiopyrylium dye, a naphthoquinone dye or an anthraquinone dye, and an organometallic complex such as a phthalocyanine compound, a naphthalocyanine compound, an azo compound, a thioamide compound, a dithiol compound or an indoaniline compound. Exemplarily, the light-to-heat conversion materials include those disclosed in Japanese Patent O.P.I. Publication Nos. 63-139191, 64-33547, 1-160683, 1-280750, 1-293342, 2-2074, 3-26593, 3-30991, 3-34891, 3-36093, 3-36094, 3-36095, 3-42281, 3-97589 and 3-103476. These compounds may be used singly or in combination. Those described in Japanese Patent O.P.I. Publication Nos. 11-240270, 11-265062, 2000-309174, 2002-49147, 2001-162965, 2002-144750, and 2001-219667 can be preferably used.

Examples of pigment include carbon, graphite, a metal and a metal oxide.

Furnace black and acetylene black is preferably used as the carbon. The graininess ($d_{50}$) thereof is preferably not more than 100 nm, and more preferably not more than 50 nm.

The graphite is one having a particle size of preferably not more than 0.5 μm, more preferably not more than 100 nm, and most preferably not more than 50 nm.

As the metal, any metal can be used as long as the metal is in a form of fine particles having preferably a particle size of not more than 0.5 μm, more preferably not more than 100 nm, and most preferably not more than 50 nm. The metal may have any shape such as spherical, flaky and needle-like. Colloidal metal particles such as those of silver or gold are particularly preferred.

As the metal oxide, materials having black color in the visible regions or materials which are electro-conductive or semi-conductive can be used. Examples of the former include black iron oxide and black complex metal oxides containing at least two metals. Examples of the latter include Sb-doped $SnO_2$ (ATO), Sn-added $In_2O_3$ (ITO), $TiO_2$, TiO prepared by reducing $TiO_2$ (titanium oxide nitride, generally titanium black). Particles prepared by covering a core material such as $BaSO_4$, $TiO_2$, $9Al_2O_3.2B_2O$ and $K_2O.nTiO_2$ with these metal oxides is usable. These oxides are particles having a particle size of not more than 0.5 μm, preferably not more than 100 nm, and more preferably not more than 50 nm.

As these light-to-heat conversion materials, black iron oxide or black complex metal oxides containing at least two metals are more preferred. The black iron oxide ($Fe_3O_4$) particles have an average particle size of from 0.01 to 1 μm, and an acicular ratio (major axis length/minor axis length) of preferably from 1 to 1.5. It is preferred that the black iron oxide particles are substantially spherical ones (having an acicular ratio of 1) or octahedral ones (having an acicular ratio of 1.4). Examples of the black iron oxide particles include for example, TAROX series produced by Titan Kogyo K.K. Examples of the spherical particles include BL-100 (having a particle size of from 0.2 to 0.6 μm, and BL-500 (having a particle size of from 0.3 to 1.0 μm. Examples of the octahedral particles include ABL-203 (having a particle size of from 0.4 to 0.5 μm, ABL-204 (having a particle size of from 0.3 to 0.4 μm, ABL-205 (having a particle size of from 0.2 to 0.3 μm, and ABL-207 (having a particle size of 0.2 μm.

The black iron oxide particles may be surface-coated with inorganic compounds such as $SiO_2$. Examples of such black iron oxide particles include spherical particles BL-200 (having a particle size of from 0.2 to 0.3 μm) and octahedral particles ABL-207A (having a particle size of 0.2 μm), each having been surface-coated with $SiO_2$.

Examples of the black complex metal oxides include complex metal oxides comprising at least two selected from Al, Ti, Cr, Mn, Fe, Co, Ni, Cu, Zn, Sb, and Ba. These can be prepared according to the methods disclosed in Japanese Patent O.P.I. Publication Nos. 9-27393, 9-25126, 9-237570, 9-241529 and 10-231441.

The complex metal oxide used in the invention is preferably a complex Cu—Cr—Mn type metal oxide or a Cu—Fe—Mn type metal oxide. The Cu—Cr—Mn type metal oxides are preferably subjected to the treatment disclosed in Japanese Patent O.P.I. Publication Nos. 8-27393 in order to reduce isolation of a 6-valent chromium ion. These complex metal oxides have a high color density and a high light heat conversion efficiency as compared with another metal oxide.

The primary average particle size of these complex metal oxides is preferably from 0.001 to 1.0 μm, and more preferably from 0.01 to 0.5 μm. The primary average particle size of from 0.001 to 1.0 μm improves a light heat conversion efficiency relative to the addition amount of the particles, and the primary average particle size of from 0.05 to 0.5 μm further improves a light heat conversion efficiency relative to the addition amount of the particles. The light heat conversion efficiency relative to the addition amount of the particles depends on a dispersity of the particles, and the well-dispersed particles have a high light heat conversion efficiency. Accordingly, these complex metal oxide particles are preferably dispersed according to a known dispersing method, separately to a dispersion liquid (paste), before being added to a coating liquid for the particle containing layer. The metal oxides having a primary average particle size of less than 0.001 are not preferred since they are difficult to disperse. A dispersant is optionally used for dispersion. The addition amount of the dispersant is preferably from 0.01 to 5% by weight, and more preferably from 0.1 to 2% by weight, based on the weight of the complex metal oxide particles.

In the invention, a preferred printing plate material, capable of being subjected to on-press development, comprises a hydrophilic support such as the surface roughened aluminum support or a support with a hydrophilic layer, and provided thereon, an image formation layer to be described later or another layer, any one of which contains a light-to-heat conversion material as described above. An image formation layer at non-image portions is prepared, as described later, so as to be capable of being removed by supplying printing ink or a dampening solution in a printing press.

(Image Formation Layer)

The image formation layer in the invention contains thermoplastic resin particles.

It is important in the invention that the thermoplastic resin particles in the image formation layer do not form a continuous phase but are in the form of particles. In the invention, the thermoplastic resin particles increase adhesion of the image formation layer to an adjoining hydrophilic layer thereof or the hydrophilic support during heating.

The printing plate material of the invention will be explained employing FIGS. 1(*a*) and 1(B). FIG. 1(*a*) shows a sectional view of the printing plate material of the invention before heated, and FIG. 1(*b*) a sectional view of the printing plate material of the invention after heated.

The printing plate material of the invention is manufactured by coating, on a hydrophilic surface (a hydrophilic support or a hydrophilic layer), a coating solution containing thermoplastic resin particles in which the thermoplastic resin particles are dispersed in an aqueous dispersion solvent, and drying to form an image formation layer containing the thermoplastic resin particles in the form of particles. In the printing plate material of the invention which is unheated, adhesion force between the hydrophilic surface and the thermoplastic resin particles (fb) and adhesion force between the thermoplastic resin particles (fp) preferably satisfy the following relationship:

$$fb>fp$$

Further, it is preferred that in the printing plate material of the invention after heated, adhesion force between the hydrophilic surface and the thermoplastic resin particles (fb') satisfies the following relationship:

$$fb'>fb$$

In FIG. 1(*a*), the printing plate material before heated comprises a hydrophilic support 4 and provided thereon, an image formation layer 3 containing thermoplastic resin particles 1, wherein the adhesion force (fb) between the hydrophilic support 4 and the thermoplastic resin particles 1 and the adhesion force (fp) between the thermoplastic resin particles preferably satisfy the following relationship:

$$fb>fp$$

In FIG. 1(*b*), the planographic printing plate material after imagewise heated comprises a hydrophilic support 4 and provided thereon, an image formation layer 3 containing unheated thermoplastic resin particles 1 and heated thermoplastic resin particles 2, and the adhesion force (fb) and the adhesion force (fb') between the hydrophilic support 4 and the thermoplastic resin particles 2 satisfy the following relationship:

$$fb'>fb$$

As materials for the thermoplastic resin particles, there are polyester resin, polystyrene resin, poly(meth)acrylate resin, polyurethane resin and their copolymer resins. Among these polymers, polyester resin is preferred in view of printing durability and on-press developability. The polyester resin has a weight average molecular weight of preferably from 5,000 to 30,000. Examples of the polyester resin particles include Vilonal MD-1200, Vilonal PMD-1200 and Vilonal PMD-1100 each available from Toyo Boseki Co., Ltd.

When a coating solution containing the polyester resin particles is coated on a hydrophilic support or on a hydrophilic layer to form an image formation layer in which the particles are present in the form of particles, the image formation layer can be adhered at a certain strength to the hydrophilic support surface or the hydrophilic layer, and can be easily removed therefrom during on-press development.

The resins described above have a glass transition point (Tg) of preferably not less than 40° C., and more preferably from 40 to 150° C., and most preferably from 50 to 120° C. A glass transition point (Tg) less than 40° C. may result in staining or in lowering of on-press developability after storage.

In order to improve both developability and printing durability, the rupture elongation of the thermoplastic resin particles is preferably less than 100%, and more preferably not more than 20%. The rupture elongation of the thermoplastic resin particles is measured according to ISO 527.

When a coating solution, in which the thermoplastic resin particles are dispersed in a dispersion solvent, is coated on a hydrophilic support or on a hydrophilic layer and dried to form an image formation layer so that the thermoplastic resin particles remain as particles. Herein the minimum film formation temperature of the thermoplastic resin particles is preferably not less than 80° C. The minimum film formation temperature can be controlled by the content in the dispersion solvent of organic solvents other than water which swell or dissolve the thermoplastic resin particles. In order to provide an image formation layer containing the thermoplastic resin particles in the particle form, the organic solvent content of the dispersion solvent is not more than 15%, and preferably not more than 10% by weight. The minimum film formation temperature of the thermoplastic resin particles in the image formation layer is determined according to a method described in ISO 2115.

The average particle size of the thermoplastic resin particles is preferably from 0.01 to 2 μm, and more preferably from 0.1 to 1 μn. The thermoplastic resin particles with an average particle size less than 0.01 μm, when a coating solution containing the particles is coated for example on a porous hydrophilic layer to be described later, are likely to enter pores or concave areas of convexo-concave structure of the porous hydrophilic layer, resulting in staining and poor developability. The thermoplastic resin particles with an average particle size exceeding 2 μm lower resolution. The thermoplastic resin particle content of the image formation layer is from 60 to 100% by weight, preferably from 80 to 100% by weight, and more preferably from 90 to 100% by weight.

The image formation layer containing thermoplastic resin particles in the particle form can be formed by coating a support with a thermoplastic resin particle-containing image formation layer coating solution and drying the coated layer at a temperature lower than a Tg of the thermoplastic resin particles. Further, such an image formation layer can be also formed by employing a thermoplastic resin particle-containing image formation layer coating solution in which the thermoplastic resin particles are dispersed in a dispersion solvent in which an organic solvent softening or dissolving the thermoplastic resin particles is reduced or eliminated, whereby the lowest film formation temperature is elevated. When the coated layer is dried at a temperature lower than a Tg of the thermoplastic resin particles for a longer time, the drying temperature may be low but is preferably at least 10° C.

A printing plate material, even though it partially comprises a continuous phase image formation layer in which thermoplastic resin particles are fused to form a continuous phase, increases the number of prints to be printed until a sufficient ink density is obtained at on-press development (at printing), resulting in increase of paper waste. Further, boundaries between image and non-image portions are not sharp, resulting in lowering of dot reproduction.

Further, when such a printing plate material comprising a continuous phase image formation layer is subjected to on-press development on a printing press, the image formation layer to be transferred to a blanket is likely to remain on the blanket to produce contamination called "ghost" at non-image portions of printed paper.

In the image formation layer containing thermoplastic resin in the form of particles (thermoplastic resin particles), it is preferred that the following formula is satisfied:

$$L \leqq d \leqq 5L$$

wherein L represents an average particle size of the thermoplastic resin particles in the particle form, and d represents a thickness of the image formation layer. The thickness d of the image formation layer containing the thermoplastic resin particles with an average particle size of L is substantially not less than L. It is preferred that the hydrophilic support surface is sufficiently covered with the thermoplastic resin particles. The sufficient coverage provides high ink receptivity at image portions. When $d \leqq 5L$, a proportion of the thermoplastic resin particles in the image formation layer contacting a hydrophilic support increases. It is important to increase adhesion of the thermoplastic resin particles in the image formation layer to the hydrophilic support by heating in order to obtain high printing durability. The relationship $d \leqq 5L$ is advantageous in the following points:

1. The relationship $d \leqq 5L$ decreases heat content of the image formation layer, and increases heat given to each of the thermoplastic resin particles during heating, providing a sufficient adhesion of the particles to the hydrophilic support.

2. The relationship $d \leqq 5L$ decreases tackiness of the image formation layer at image portions by heating, contacting the hydrophilic support, whereby the image formation layer is difficult to transfer to for example, a blanket during printing.

Figure 2:
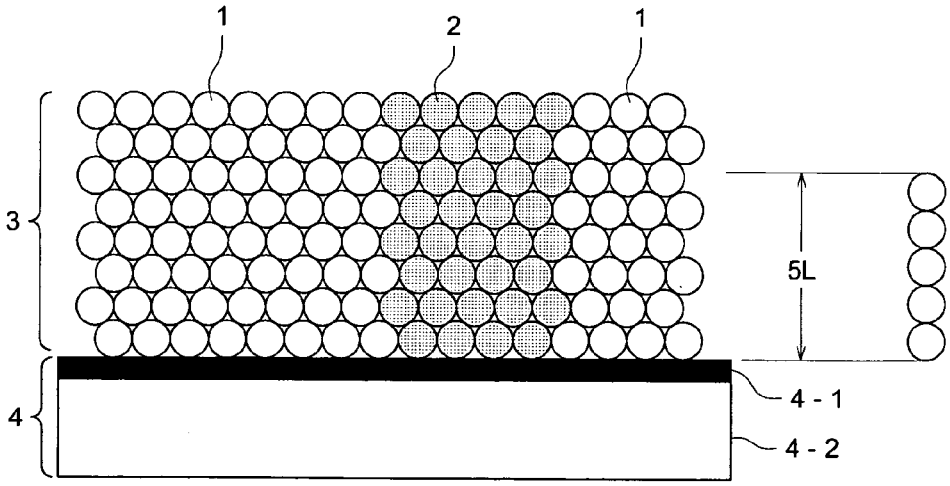
FIG. 2 is a sectional view of one embodiment of the printing plate material of the invention.
Figure 3:
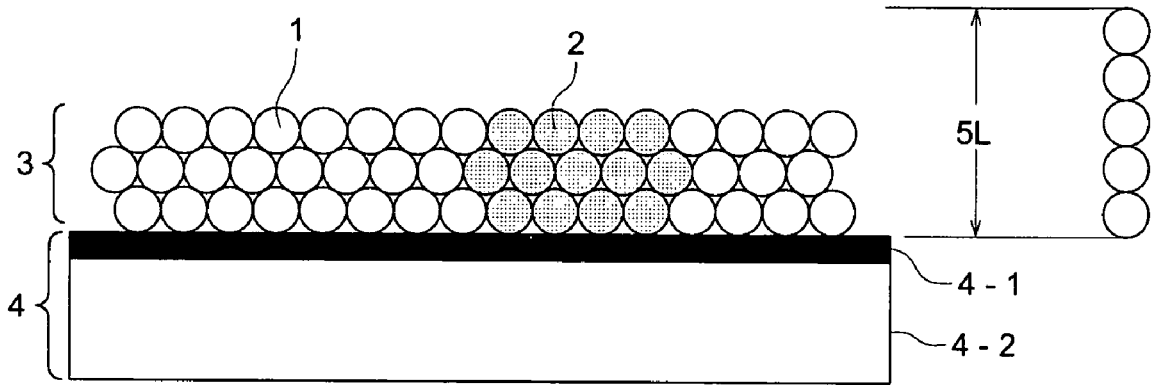
FIG. 3 shows a sectional view of another embodiment of the planographic printing plate material of the invention.

FIG. 2 or 3 represents another embodiment of the printing plate material of the invention. In FIG. 2, the printing plate material after imagewise heated comprises a hydrophilic support 4 with a hydrophilic layer 4-1 provided on a support 4-2, and an image formation layer 3 containing unheated thermoplastic resin particles 1 and heated thermoplastic resin particles 2, wherein the thickness of the image formation layer is more than 5L, L representing an average particle size of the thermoplastic resin particles. In FIG. 3, the printing plate material after imagewise heated comprises a hydrophilic support 4 with a hydrophilic layer 4-1 provided on a support 4-2, and an image formation layer 3 containing unheated thermoplastic resin particles 1 and heated thermoplastic resin particles 2, wherein the thickness of the image formation layer is less than 5L, L representing an average particle size of the thermoplastic resin particles.

In FIGS. 2 and 3, a hydrophilic layer containing a light-to-heat conversion material is provided on a hydrophilic support, and an image formation layer, containing thermoplastic resin particles piled up in a stone wall form, is provided on the hydrophilic layer. When the printing plate material is exposed to infrared laser, the hydrophilic layer and the image formation layer at exposed portions are heated, whereby adhesion of the thermoplastic resin particles to the hydrophilic layer and adhesion between the thermoplastic resin particles are increased. The printing plate material shown in FIG. 3 carries a greater amount of the thermoplastic resin particles at heated (exposed) portions and their vicinity than the printing plate material shown in FIG. 2, and the former shows higher mechanical strength of the image formation layer than the latter.

(Other Substances)

The image formation layer in the invention can further contain the following substances.

The image formation layer preferably contains the light-to-heat conversion materials described above, water soluble resins or water dispersible resins.

It is preferred that the image formation layer contains the light-to-heat conversion materials in an amount of not more than 10% by weight.

The water soluble resins or water dispersible resins include oligosaccharides, polysaccharides, polyethylene oxide, polypropylene oxide, polyvinyl alcohol, polyethylene glycol (PEG), polyvinyl ether, a styrene-butadiene copolymer, a conjugation diene polymer latex of methyl methacrylate-butadiene copolymer, an acryl polymer latex, a vinyl polymer latex, polyacrylic acid, polyacrylic acid salts, polyacrylamide, and polyvinyl pyrrolidone.

Among these, oligosaccharides, polysaccharides, polyacrylic acid, polyacrylic acid salts (sodium salt, etc.), and polyacrylamide are preferred.

Examples of the oligosaccharides include raffinose, trehalose, maltose, galactose, sucrose, and lactose. Among these, trehalose is preferred.

Examples of the polysaccharides include starches, celluloses, polyuronic acid and pullulan. Among these, cellulose derivatives such as a methyl cellulose salt, a carboxymethyl cellulose salt and a hydroxyethyl cellulose salt are preferred, and a sodium or ammonium salt of carboxymethyl cellulose is more preferred.

The molecular weight of polyacrylic acid, polyacrylic acid salts (sodium salt, etc.), and polyacrylamide has a molecular weight of preferably from 3,000 to 5,000,000, and more preferably from 5,000 to 1,000,000.

The water soluble resins or water dispersible resins may be added to the image formation layer in order to improve an anti-stain property after storage, heat resistance or on-press-developability. However, they may lower strength of the image formation layer at image portions, and are preferably added to the image formation layer in the possible lowest amount. The addition amount of the water soluble resins or water dispersible resins in the image formation layer is preferably not more than 30% by weight, more preferably not more than 20% by weight, and most preferably from 1 to 20% by weight. The addition amount thereof in the image formation layer may be zero percent by weight.

In the image formation layer, the thermoplastic resin particles in the particle form improve an anti-stain property after storage or heat resistance, and can reduce the addition amount of the water soluble resins or water dispersible resins.

A water-soluble surfactant may be contained in the image formation layer in the invention. A silicon atom-containing surfactant and a fluorine atom-containing surfactant can be used. The image formation layer in the invention can contain an acid (phosphoric acid or acetic acid) or an alkali (sodium hydroxide, silicate, or phosphate) to adjust pH.

The coating amount of the image formation layer is from 0.01 to 10 g/m$^2$, preferably from 0.1 to 3 g/m$^2$, and more preferably from 0.2 to 2 g/m$^2$.

(Protective Layer)

A protective layer can be provided on the image formation layer. As materials used in the protective layer, the water soluble resins or the water dispersible resins described above can be preferably used. The protective layer in the invention may be a hydrophilic overcoat layer disclosed in Japanese Patent O.P.I. Publication Nos. 2002-19318 and 2002-86948.

The coating amount of the protective layer is from 0.01 to 10 g/m$^2$, preferably from 0.1 to 3 g/m$^2$, and more preferably from 0.2 to 2 g/m$^2$.

On-press development is carried out by supplying printing ink or a dampening solution to the (exposed) planographic printing plate material. The dampening solution used for printing is generally acidic. Exposure by infrared laser can be carried out on a printing press.

(On-Press Development)

In the planographic printing plate material of infrared laser heat melting or heat fusible type, the image formation layer forms image portions at exposed portions and forms oleophilic non-image portions at unexpected portions where the image formation layer at non-image portions is removed. Removal of the image formation layer at non-image portions can be carried out employing water, and can be carried out employing printing ink or a dampening solution on a printing press (subjected to so-called on-press development).

Removal on a press of the image formation layer at non-image portions (unexposed portions) of a printing plate material, which is mounted on the plate cylinder, can be carried out by bringing a dampening roller and an inking roller into contact with the image formation layer while rotating the plate cylinder, and can be also carried out according to various sequences such as those described below or another appropriate sequence. The supplied amount of dampening solution may be adjusted to be greater or smaller than the amount ordinarily supplied in printing, and the adjustment may be carried out stepwise or continuously.

(1) A dampening roller is brought into contact with the image formation layer of a printing plate material on the plate cylinder during one to several tens of rotations of the plate cylinder, and then an inking roller brought into contact with the image formation layer during the next one to tens of rotations of the plate cylinder. Thereafter, printing is carried out.

(2) An inking roller is brought into contact with the image formation layer of a printing plate material on the plate cylinder during one to several tens of rotations of the plate cylinder, and then a dampening roller brought into contact with the image formation layer during the next one to tens of rotations of the plate cylinder. Thereafter, printing is carried out.

(3) An inking roller and a dampening roller are brought into contact with the image formation layer of a printing plate material on the plate cylinder during one to several tens of rotations of the plate cylinder. Thereafter, printing is carried out.

EXAMPLES

The present invention will be explained below employing the following examples, but is not limited thereto.

Example 1

Preparation of Support 1

A 0.24 mm thick aluminum plate (material 1050, refining H16) was immersed in an aqueous 1% by weight sodium hydroxide solution at 50° C. to give an aluminum dissolution amount of 2 g/m$^2$, washed with water, immersed in an aqueous 0.1% by weight hydrochloric acid solution at 0.25° C. for 30 seconds to neutralize, and then washed with water.

Subsequently, the aluminum plate was subjected to an electrolytic surface-roughening treatment in an electrolytic solution containing 10 g/liter of hydrochloric acid and 0.5 g/liter of aluminum at a peak current density of 50 A/dm$^2$ employing an alternating current with a sine waveform, in which the distance between the plate surface and the electrode was 10 mm. The electrolytic surface-roughening treatment was divided into 12 treatments, in which the quantity of electricity used in one treatment (at a positive polarity) was 40 C/dm$^2$, and the total quantity of electricity used (at a positive polarity) was 480 C/dm$^2$. Standby time of 5 seconds, during which no surface-roughening treatment was carried out, was provided after each of the separate electrolytic surface-roughening treatments.

Subsequently, the resulting aluminum plate was immersed in an aqueous 1% by weight sodium hydroxide solution at 50° C. and etched to give an aluminum etching amount (including smut produced on the surface) of 1.2 g/m$^2$, washed with water, neutralized in an aqueous 10% by weight sulfuric acid solution at 25° C. for 10 seconds, and washed with water. Subsequently, the aluminum plate was subjected to anodizing treatment in an aqueous 20% by weight sulfuric acid solution at a constant voltage of 20 V, in which a quantity of electricity of 150 C/dm$^2$ was supplied, and washed with water.

The washed surface of the plate was squeegeed, and the plate was immersed in an aqueous 1% by weight disodium hydrogen phosphate solution at 70° C. for 30 seconds, washed with water, and dried at 80° C. for 5 minutes. Thus, a surface roughened support 1 was obtained. The surface roughened support 1 had a surface roughness Ra of 460 nm. Preparation of planographic printing plate material samples 1 through 8.

Materials as shown in Table 1 were mixed and sufficiently stirred at in a homogenizer, and filtered to obtain a hydrophilic layer coating solution 1 having a solid content of 15% by weight.

The resulting coating solution 1 was coated on the surface roughened support 1 employing a wire bar, and dried at 100° C. for 3 minutes to give a hydrophilic layer having a dry thickness of 1.5 g/m$^2$. Subsequently, the resulting material was then subjected to aging at 60° C. for 24 hours. Thus, a support 1 with a hydrophilic layer (hereinafter also referred to as a hydrophilic support 1) was obtained.

TABLE 1

| (Composition of hydrophilic layer coating solution 1) | |
|---|---|
| Colloidal silica (alkali type): Snowtex S (solid 30% by weight, produced by Nissan Kagaku Co., Ltd.) | 13.30 parts by weight |
| Necklace shaped colloidal silica (alkali type): Snowtex PSM (solid 20% by weight, produced by Nissan Kagaku Co., Ltd.) | 29.93 parts by weight |
| Cu—Fe—Mn type metal oxide black pigment: TM-3550 black aqueous dispersion {prepared by dispersing TM-3550 black powder having a particle size of 0.1 μm produced by Dainichi Seika Kogyo Co., Ltd. in water to give a solid content of 40% by weight (including 0.2% by weight of dispersant)} | 3.75 parts by weight |
| Layer structural clay mineral particles: Montmorillonite Mineral Colloid MO gel prepared by vigorously stirring montmorillonite Mineral Colloid MO; gel produced by Southern Clay Products Co., Ltd.(average particle size: 0.1 μm) in water in a homogenizer to give a solid content of 5% by weight | 3.00 parts by weight |
| Aqueous 10% by weight sodium phosphate·dodecahydrate (Reagent produced by Kanto Kagaku Co., Ltd.) solution | 0.75 parts by weight |
| Aqueous 4% by weight sodium carboxymethyl cellulose (CMC1220, Reagent produced by Daicel Kagaku Co., Ltd.) solution | 7.50 parts by weight |
| Porous metal oxide particles Silton AMT08 (porous aluminosilicate particles having an average particle size of 0.6 μm, produced by Mizusawa Kagaku Co., Ltd.) | 1.50 parts by weight |
| Porous metal oxide particles Silton JC30 (porous aluminosilicate particles having an average particle size of 3 μm, produced by Mizusawa Kagaku Co., Ltd.) | 1.50 parts by weight |
| Pure water | 38.77 parts by weight |

Materials as shown in Table 2 were mixed and sufficiently stirred at in a homogenizer, and filtered to obtain an image formation layer coating solution 1 having a solid content of 10% by weight. The resulting image formation layer coating solution 1 was coated on the hydrophilic layer of the hydrophilic support 1 employing a wire bar, and dried at a temperature as shown in Table 3 for 3 minutes to give an image formation layer having a dry thickness of 0.5 g/m$^2$. Subsequently, the resulting material was then subjected to aging at 60° C. for 24 hours. Thus, printing plate material sample 1 was obtained.

TABLE 2

| (Composition of image formation layer coating solution 1) | |
|---|---|
| Water-dispersion copolyester resin emulsion Vylonal PMD-1200 (Tg: 67° C., rupture elongation: 5%, a solid content of 41% by weight, produced by Toyo Boseki Co., Ltd.) | 22.4 parts by weight |
| Aqueous solution of water soluble resin, sodium polyacrylate: AQUALIC DL522 (solid content 10%, produced by Nippon Shokubai Co., Ltd.) | 4.0 parts by weight |
| Pure water | 73.6 parts by weight |

Planographic printing plate material samples 2 through 8 were prepared in the same manner as in printing plate material sample 1, except that the thermoplastic resin particle emulsion as shown in Table 3 was used and the drying temperature was changed to that as shown in Table 3. Herein, the content ratio of the thermoplastic resin to the water soluble resin, and the coating amount of the thermoplastic resin and the water soluble resin were the same as printing plate material sample 1.

TABLE 3

| Sample No. | Thermoplastic resin particle emulsion used | Solid content (%) | Tg (° C.) | Drying temperature (° C.) |
|---|---|---|---|---|
| 1 (Comp.) | Vylonal PMD-1200 Polyester resin emulsion | 41 | 67 | 90 |
| 2 (Comp.) | Vylonal PMD-1200 Polyester resin emulsion | 41 | 67 | 70 |
| 3 (Inv.) | Vylonal PMD-1200 Polyester resin emulsion | 41 | 67 | 50 |
| 4 (Comp.) | Vylonal PMD-1100 Polyester resin emulsion | 31 | 40 | 45 |
| 5 (Inv.) | Vylonal PMD-1100 Polyester resin emulsion | 31 | 40 | 30 |
| 6 (Inv.) | NIPOL LX303A Styrene-butadiene resin emulsion | 50 | 100 | 80 |
| 7 (Inv.) | NIPOL 2507H Styrene-butadiene resin emulsion | 52 | 58 | 40 |
| 8 (Inv.) | NIPOL LX855EX1 Alkyl acrylate resin emulsion | 45 | 36 | 30 |

Comp.: Comparative,
Inv.: Inventive
NIPOL LX303A, NIPOL 2507H, NIPOL LX855EX1 each produced by ToyoBoseki Co., Ltd.

(Image Formation Employing Infrared Laser)

Each of the resulting printing plate samples was wound around an exposure drum and imagewise exposed. Exposure was carried out employing an infrared laser (having a wavelength of 830 nm and a beam spot diameter of 18 μm) at a resolution of 2400 dpi and at a screen line number of 175 to form a solid image, and a dot image with a dot area of 1 to 99%. In the exposure, the exposure energy was 300 $mJ/cm^2$. The term, "dpi" shows the number of dots per 2.54 cm.

(Printing Method)

The exposed printing plate material was mounted on a plate cylinder of a printing press and then printing was carried out in the same printing sequence as a conventional PS plate. Printing was carried out employing a printing press, DAIYA 1F-1 produced by Mitsubishi Jukogyo Co., Ltd., and employing coated paper sheets, a dampening solution, a 2% by weight solution of Astromark 3 (produced by Nikken Kagaku Kenkyusyo Co., Ltd.), and printing ink (TK Hyunity Magenta, produced by Toyo Ink Manufacturing Co.). Evaluation (On-press Developability)

The smallest number of paper sheets printed from when printing started until when on-press development was completed was counted and evaluated as a measure of on-press developability. Time when prints having no stain at non-image portions, an ink density of 1.6 or more at solid images, and reproduced 95% dot area were obtained was regarded as the completion point of the on-press development. The ink density was determined at M mode employing a densitometer Macbeth RD 918.

(Resistance to Blanket Contamination)

After printing was carried out employing the exposed sample above to obtain twenty thousand copies, a first contamination level on the blanket was observed. Next, a Kodak Polychrome X thermo printing plate LT-3 (produced by Kodak Polychrome Graphic Co., Ltd.) was exposed in the same manner as above, and developed employing Kodak Polychrome plate processor PK910 II (produced by Kodak Polychrome Graphic Co., Ltd.). After printing was carried out employing the developed sample above to obtain twenty thousand copies, a second contamination level on the blanket was observed in the same manner as above. Then, both contamination levels were compared, and evaluated according to the following criteria:

A: Both contamination levels were the same.

B: The first contamination level was higher than the second one.

C: The first contamination level was far higher than the second one, and was such that contamination could not be removed with a cleaner.

(Anti-stain Property at Non-image Portions)

Printing was carried out for 20,000 copies. Stains at non-image portions were observed in the $100^{th}$ copy, $5,000^{th}$ copy, $10,000^{th}$ copy, $15,000^{th}$ copy and $20,000^{th}$ copy, and were evaluated according to the following criteria:

A: No stains were observed.

B: Slight stains were observed.

C: Apparent stains were observed.

(Dot Quality)

Printing was carried out for 200 copies. The shape of dots was observed in the $200^{th}$ copy, employing a 100 power magnifier. The dot shape was evaluated for uniformity of small dots, smoothness of dot edge of an around 50% dot area, and developability at large dot portions. Dot quality was evaluated according to the following criteria:

A: Good dot quality was observed through the small dots to large dots.

B: Some dots irregular in a dot shape were observed.

C: Uneven dot quality was observed through the small dots to large dots.

(Printing Durability)

Printing was carried out for 20,000 copies. The number of prints printed from when printing started till when dots in the image with 3% dot area began disappearing was counted, and evaluated as a measure of printing durability.

The results are shown in Table 4.

TABLE 4

| Sample No. | On-press develop-ability (number) | Anti-stain property at non-image portions (number) 100th | 5,000th | 10,000th | 15,000th | 20,000th | Dot quality at image portions | Resistance to blanket contamination | Printing durability |
|---|---|---|---|---|---|---|---|---|---|
| 1 (Comp.) | 100 or more | C | C | C | C | C | C | C | — |
| 2 (Comp.) | 40 | B | C | C | C | C | C | B | — |
| 3 (Inv.) | 10 | A | A | A | A | A | A | A | 20,000 or more |
| 4 (Comp.) | 100 or more | C | C | C | C | C | C | A | — |
| 5 (Inv.) | 15 | A | A | A | A | A | A | A | 20,000 |
| 6 (Inv.) | 15 | A | A | A | A | A | A | A | 14,000 |
| 7 (Inv.) | 15 | A | A | A | A | A | A | A | 16,000 |
| 8 (Inv.) | 20 | A | A | A | A | B | B | A | 16,000 |

Comp: Comparative,
Inv.: Inventive
In table 4, "—" shows that since on-press development was impossible or stain markedly occurred at the non-image portions, no evaluation was made.

As is apparent from Table 4, inventive samples 3, and 5 through 8 provide excellent results in on-press developability, the anti-stain property at the non-image portions, dot quality, resistance to blanket contamination and printing durability, compared with comparative samples 1, 2 and 4. This is considered to result from increase of adhesion of the image formation to the support.

Example 2

Preparation of Hydrophilic Support 2

The support 1 obtained above was immersed in an aqueous 0.1% by weight ammonium acetate (produced by Kanto Kagaku Co., Ltd.) solution at 80° C. for 30 seconds with stirring, washed with water, dried, then immersed in an aqueous 0.1% by weight carboxymethylcellulose 1150 (produced by Daicel Kagaku Co., Ltd.) solution at 80° C. for 30 seconds with stirring, washed with water, and dried. Thus, a support with a hydrophilic layer (a hydrophilic support 2) was obtained.

Preparation of Printing Plate Material Samples 9 through 15

Printing plate material samples 9 through 15 were prepared in the same manner as in planographic printing plate material sample 3, except that the following image formation layer coating solution (2) composition as shown in Table 5 was coated on the hydrophilic support 2 and dried to form an image formation layer having each component content as shown in Table 6 of the composition. In the above, drying temperature was 50° C.

The resulting samples were evaluated in the same manner as in Example 1, except that printing was carried out to obtain 50,000 copies for printing durability evaluation. The results are shown in Table 7.

TABLE 5

| (Composition of image formation layer coating solution 2) |
|---|
| Water-dispersion copolyester resin emulsion Vylonal MD-1200 (Tg: 67° C., rupture elongation: 5%, a solid content of 34% by weight, produced by Toyo Boseki Co., Ltd.) |
| Aqueous solution of sodium polyacrylate: AQUALIC DL522 (solid content 10%, produced by Nippon Shokubai Co., Ltd.) |
| Light-to-heat conversion material: an aqueous 1% by weight aqueous solution of ADS830WS (produced by American Dye Source Co., Ltd.) |
| Pure water |

TABLE 6

| Materials | Concentration | | Sample No. 9 | 10 | 11 | 12 | 13 | 14 | 15 |
|---|---|---|---|---|---|---|---|---|---|
| Vylonal MD-1200 | 34% by weight | Addition mount parts by weight | 15.1 | 17.4 | 20.5 | 20.9 | 21.4 | 21.9 | 22.1 |

TABLE 6-continued

| Materials | Concentration | | Sample No. 9 | 10 | 11 | 12 | 13 | 14 | 15 |
|---|---|---|---|---|---|---|---|---|---|
| AQUALIC DL522 | 10% by weight | Addition mount parts by weight | 24.0 | 16.0 | 5.6 | 4.0 | 2.4 | 0.8 | 0.0 |
| ADS830WS | 1% by weight | Addition mount parts by weight | 48.0 | 48.0 | 48.0 | 48.0 | 48.0 | 48.0 | 48.0 |
| Pure water | | Addition mount parts by weight | 12.9 | 18.6 | 25.9 | 27.1 | 28.2 | 29.3 | 29.9 |
| | | Total | 100.0 | 100.0 | 100.0 | 100.0 | 100.0 | 100.0 | 100.0 |

TABLE 7

| Sample No. | Thermoplastic resin particles: Materials | Thermoplastic resin particles: Content by weight (%) | Water soluble resin content by weight (%) | Drying temperature (° C.) |
|---|---|---|---|---|
| 9 (Inv.) | Vylonal MD-1200 | 64 | 30 | 50 |
| 10 (Inv.) | Vylonal MD-1200 | 74 | 20 | 50 |
| 11 (Inv.) | Vylonal MD-1200 | 87 | 7 | 50 |
| 12 (Inv.) | Vylonal MD-1200 | 89 | 5 | 50 |
| 13 (Inv.) | Vylonal MD-1200 | 91 | 3 | 50 |
| 14 (Inv.) | Vylonal MD-1200 | 93 | 1 | 50 |
| 15 (Inv.) | Vylonal MD-1200 | 94 | 0 | 50 |

| Sample No. | On-press develop-ability (number) | Anti-stain property at non-image portions (number): 100th | 5,000th | 10,000th | 15,000th | 20,000th | Dot quality at image portions | Resistance to blanket contamination | Printing durability |
|---|---|---|---|---|---|---|---|---|---|
| 9 (Inv.) | 15 | A | A | A | A | A | A | A | 20,000 |
| 10 (Inv.) | 15 | A | A | A | A | A | A | A | 30,000 |
| 11 (Inv.) | 10 | A | A | A | A | A | A | A | 38,000 |
| 12 (Inv.) | 10 | A | A | A | A | A | A | A | 40,000 |
| 13 (Inv.) | 10 | A | A | A | A | A | A | A | 44,000 |
| 14 (Inv.) | 10 | A | A | A | A | A | A | A | 48,000 |
| 15 (Inv.) | 10 | A | A | A | A | A | A | A | Not less than 50,000 |

Inv.: Inventive

As is apparent from Table 7, inventive samples provide excellent results in on-press developability, the anti-stain property at the non-image portions, resistance to blanket contamination and printing durability, even when the water soluble resin content is small.

Example 3

Printing plate material samples 16 through 23 were prepared in the same manner as in printing plate material sample. 3 of Example 1, except that the image formation layer thickness was changed to those as shown in Table 8. The resulting samples were evaluated in the same manner as in Example 1. The results are shown in Table 8. The thickness of the image formation layer was measured from a section of the samples employing an electron microscope. The average particle size L of Vylonal PMD-1200 used as thermoplastic resin particles was 0.15 μm.

TABLE 8

| Sample No. | Image formation layer thickness (μm) | On-press develop-ability (number) | Anti-stain property at non-image portions (number) 100th | 5,000th | 10,000th | 15,000th | 20,000th | Dot quality at image portions | Resistance to blanket contamination | Printing durability |
|---|---|---|---|---|---|---|---|---|---|---|
| 16 (Inv.) | 0.2 | 10 | A | A | A | A | A | A | A | 20,000 or more |
| 17 (Inv.) | 0.3 | 10 | A | A | A | A | A | A | A | 20,000 or more |
| 18 (Inv.) | 0.4 | 10 | A | A | A | A | A | A | A | 20,000 or more |
| 19 (Inv.) | 0.5 | 10 | A | A | A | A | A | A | A | 20,000 or more |
| 20 (Inv.) | 0.6 | 10 | A | A | A | A | A | A | A | 20,000 or more |
| 21 (Inv.) | 0.7 | 10 | A | A | A | A | A | A | A | 20,000 or more |
| 22 (Inv.) | 0.8 | 20 | A | A | A | A | B | A | B | 18,000 |
| 23 (Inv.) | 1.0 | 20 | A | A | A | A | B | B | B | 16,000 |

Inv.: Inventive

As is apparent from Table 8, inventive samples 16 through 21, which satisfy the relationship $L \leqq d \leqq 5L$, provide excellent printing properties.

What is claimed is:

1. A printing plate material comprising a hydrophilic support and provided thereon, an image formation layer containing thermoplastic resin particles in an amount of from 60 to 100% by weight, the thermoplastic resin particles having a glass transition point (Tg) and an average particle size of from 0.01 to 2 μm, and wherein the following relation is satisfied, $$L \leqq d \leqq 5L$$

wherein d represents the thickness of the image formation layer, and L represents the average particle size of the thermoplastic resin particles.

2. The printing plate material of claim 1, wherein the content of the thermoplastic resin particles in the image formation layer is from 80 to 100% by weight.

3. The printing plate material of claim 2, wherein the image formation layer contains a water soluble resin or a water dispersible resin in an amount of not more than 20% by weight.

4. The printing plate material of claim 1, wherein the glass transition point (Tg) of the thermoplastic resin particles is not less than 40° C.

5. The printing plate material of claim 1, wherein the thermoplastic resin particles are thermoplastic polyester particles.

6. The printing plate material of claim 1, wherein the image formation layer contains a water soluble resin or a water dispersible resin in an amount of not more than 20% by weight.

7. The printing plate material of claim 6, wherein the water soluble resin or the water dispersible resin is selected from the group consisting of oligosaccharides, polysaccharides, polyacrylic acid, polyacrylic acid salts, and polyacrylamide.

8. The printing plate material of claim 1, wherein the image formation material contains a light-to-heat conversion material in an amount of not more than 10% by weight.

9. The printing plate material of claim 1, wherein the image formation layer contains a light-to-heat conversion material in an amount of not more than 10% by weight, and a water soluble resin or a water dispersible resin in an amount of not more than 20% by weight.

10. A process of manufacturing a printing plate material comprising a hydrophilic support and provided thereon, an image formation layer containing thermoplastic resin particles having a glass transition point (Tg) and an average particle size of from 0.01 to 2 μm, the process comprising the steps of:

providing a coating solution of the image formation layer;

coating the coating solution on the support to form a coated layer on the support; and drying the coated layer at a temperature of not more than the glass transition point (Tg) of the resin particles to form an image formation layer so that the following relation is satisfied, $$L \leqq d \leqq 5L$$

wherein d represents the thickness of the image formation layer, and L represents the average particle size of the thermoplastic resin particles.

* * * * *